United States Patent [19]

Bodnar

[11] Patent Number: 4,569,315

[45] Date of Patent: Feb. 11, 1986

[54] POWER STARTER ATTACHMENT FOR LAWNMOWERS AND OTHER APPLIANCES HAVING SMALL INTERNAL COMBUSTION ENGINES

[76] Inventor: George Bodnar, 61 Rodney Dr., Knoxfield, Australia

[21] Appl. No.: 680,818

[22] Filed: Dec. 12, 1984

[51] Int. Cl.[4] ..... F02N 11/12

[52] U.S. Cl. ..... 123/179 SE; 74/6

[58] Field of Search ..... 123/179 SE; 74/6; 56/10.5

[56] References Cited

U.S. PATENT DOCUMENTS

| | | | |
|---|---|---|---|
| 969,162 | 9/1910 | Hodgkinson | 74/6 |
| 2,932,292 | 4/1960 | Trotter et al. | 123/179 SE |
| 3,537,436 | 11/1970 | Heisler | 123/179 SE |
| 3,645,247 | 2/1972 | D'Ambrosio | 123/179 SE |

*Primary Examiner*—Andrew M. Dolinar

*Attorney, Agent, or Firm*—William F. Frank

[57] ABSTRACT

A device for starting small internal combustion engines using a hand-held power drill for rotating the starting device. The device consists of cup attached to the crankshaft of the engine. The upwardly facing open end of the cup has two diametrically opposing slots therein. For rotating the cup there is provided a spindle, one end of which is insertable in the chuck of the drill, the other end having a depending cylindrical shell attached which is fitted inside the cup, the shell having and engagement pin passing diametrically through the wall of the shell and providing a projecting portion on each side to engage the slots in the cup.

1 Claim, 3 Drawing Figures

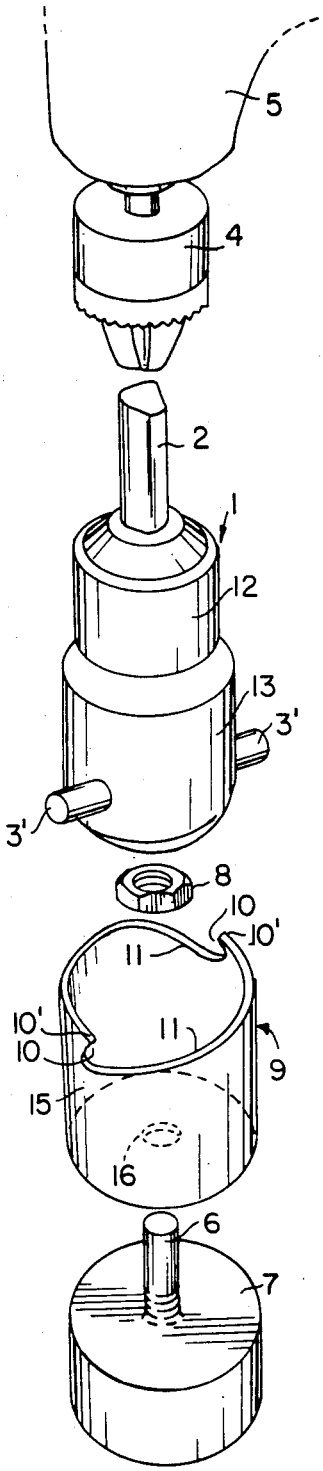
FIG. 1
FIG. 2
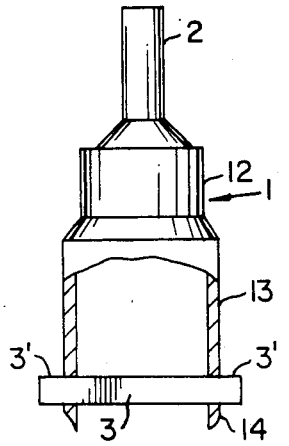
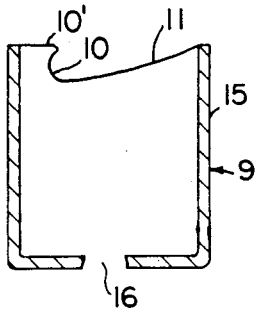
FIG. 3

POWER STARTER ATTACHMENT FOR LAWNMOWERS AND OTHER APPLIANCES HAVING SMALL INTERNAL COMBUSTION ENGINES

This invention relates to a starter connection which furnishes a temporary connection between a starter motor and an engine to be started.

Difficulties in starting small engines are commonplace. For example, the weekend gardener will often experience difficulty in starting a garden mower using the conventional lanyard and pulley system, if the motor is cold or the spark-plug even slightly dirty.

Such a motor can be started by a skilled mower mechanic, using a socket attached to an electric drill engaged with the nut which secures the flywheel to the crankshaft. The problem is, of course, that, unless the socket is rapidly disengaged from the nut once the engine fires, the electric drill is itself rotated causing a hazard to the mechanic or bystanders.

The object of the invention is to overcome the problem stated above and to provide a convenient means of starting a small internal combustion engine, if an electricly powered hand drill is available.

The invention, therefore, provides a starter connector which furnishes a temporary connection between a starter motor and an engine to be started, which comprises link means in combination with engagement means, the link means being adapted to join the starter motor and the engagement means, the engagement means being adapted to join the crankshaft of the engine permanently.

The engagement means may join the crankshaft directly, that is, without modification of or addition to the crankshaft.

In another embodiment the engagement means is mounted on the handlebar of the lawn-mower and connected to the crankshaft by means of a flexible shaft assembly.

The invention will now be illustrated by reference to one embodiment, in which:

FIG. 1 is an exploded, part-fragmentary, perspective view of a starter connector according to the invention, shown in conjuntion with a starter motor, an interlocking means and a portion of a motor to be started;

FIG. 2 is a cross-sectional view of the starter connector; and

FIG. 3 is a cross-sectional view of the interlocking means.

Referring now to FIG. 1, numeral 1 idicates the starter connector generally, 2 indicates a link spindle and numerals 3' indicate projecting portions of an engagement pin 3. Spindle 2 may be gripped by chuck 4 connected to a starter motor 5 such as a power drill. As can be seen in FIGS. 1 and 2, attached to one end of link spindle 2 is a cylindrical base 12 from which extends a hollow cylindrical shell 13. The engagement pin 3 passes through the walls of shell 13 at a distance from the open end of shell 13 to form skirt portion 14 which functions as a safety device as will be explained below.

Numeral 6 indicates a crankshaft of a small motor, such as in a lawn-mower (not shown). 7 indicates a flywheel and 8 a connecting nut.

Interlocking means 9 is provided with two diametrically opposite slots 10, shaped so they may accomodate ends 3' of the engagement pin. Each slot 10 points circumferentially in the same direction, anti-clockwise in this case, and each slot has a sloping lead-in portion 11. Engagement means 9 can be seen to be a cup 15 having an opening 16 in the closed end to receive the crankshaft 6, the connecting nut 8 being on the interior of the cup 15. It will be noted that each slot 10 has an overhanging lip 10' which engages the upper surface of projecting portion 3' when the starter connector 1 is inserted into cup 15 and prevents each portion 3' from disengagement with slot 10 when the starter motor 5 is activated.

In use, starter connector 1 is gripped by chuck 4' and interlocking means 9 is connected to crankshaft 6. The starter connector 1 engages the interlocking means 9 by means of ends 3 of the engagement pin and slots 10. Motor 5 is started and crankshaft 6 forced to rotate. When the motor (not shown) fires, ends 31 ride out of slots 10 on lead-in portions 11, the lead-in portions acting as cam surfaces. When the portions 3' ride out of slots 10 along lead-in portions 11, the skirt 14 on shell 13 of the starter connector 1 contacts the upper inner surfaces of cup 15 and prevents the starter connector 1 with attached starter motor 5 from being hurled off the cup 15 by the torque of the thus started lawn mower engine and injurying the operator of the starter motor.

Interlocking means 9 may be provided with an internal, spring loaded protective cap (not shown) which extends upwards to the mouth of the interlocking means 9, once ends 31 have ridden out of slots 10, and starter connector 1 is removed from interlocking means 9. This protective cap partially seals the interior of interlocking means 9, acting as a safety device.

The claims defining the invention are as follows:

I claim:

1. A device for starting small internal combustion engines comprising a cup which is attached to the crankshaft of said engine, the open end of the cup being upwardly facing and a starter connector comprising a link spindle to be gripped by an electric powered hand dril at one end of the spindle, a base attached to the other end of said spindle from which base extends a cylindrical shell, an engagement pin passing through the walls of the shell diametrically and providing a projecting portion exterior of said shell on each side, the open end of said cup having diametrically opposed slots therein to receive the projecting portions of said engagement pin, each of said slots having a sloping lead-in portion, each of said slots further having an overhanging lip to retain the projecting portion engaged therein, said engagement pin passing through the walls of said shell at a distance from its open end to form a skirt portion of the open end, said skirt portion contacting the upper inner surface of said cup to retain the starter connector on the cup when the projecting portions are removed from said slots by the torque of the started engine.

* * * * *